US007942574B2

(12) United States Patent
Hozumi et al.

(10) Patent No.: US 7,942,574 B2
(45) Date of Patent: May 17, 2011

(54) PORTABLE WATCH

(75) Inventors: Yoshio Hozumi, Chiba (JP); Kinshuro Itoh, Chiba (JP)

(73) Assignee: Seiko Instruments Inc. (JP)

( * ) Notice: Subject to any disclaimer, the term of this patent is extended or adjusted under 35 U.S.C. 154(b) by 0 days.

(21) Appl. No.: 12/658,823

(22) Filed: Feb. 16, 2010

(65) Prior Publication Data

US 2010/0220562 A1 Sep. 2, 2010

(51) Int. Cl.
*G04B 29/00* (2006.01)
*G04B 37/00* (2006.01)

(52) U.S. Cl. ..... 368/308; 368/319

(58) Field of Classification Search ..... 368/288, 368/306–308, 319–321
See application file for complete search history.

(56) References Cited

U.S. PATENT DOCUMENTS 1,023,384 A * 4/1912 Matalene ..... 368/306
1,292,540 A * 1/1919 Tough ..... 368/289
1,521,208 A * 12/1924 Von Kersburg ..... 368/106
3,517,501 A * 6/1970 Klingenberg ..... 368/288
3,817,026 A * 6/1974 Lopez ..... 368/312
6,210,034 B1 * 4/2001 Latini ..... 368/289
6,679,624 B1 * 1/2004 Mouawad ..... 368/216
7,347,620 B2 * 3/2008 Omori et al. ..... 368/319
7,401,975 B2 * 7/2008 Hiranuma et al. ..... 368/319
7,490,979 B2 * 2/2009 Hiranuma et al. ..... 368/295
7,517,139 B2 * 4/2009 Hiranuma et al. ..... 368/288
7,572,049 B2 * 8/2009 Hiranuma ..... 368/295

* cited by examiner

*Primary Examiner* — Sean Kayes
(74) *Attorney, Agent, or Firm* — Adams & Wilks

(57) ABSTRACT

A portable watch is equipped with a watch exterior member, a crown, a crown lock button, and an urging member. In a case band with which the exterior member is equipped, there are formed a crown mounting hole and a member mounting portion communicating with this hole and vertically perpendicular thereto. The crown is arranged in the hole. The crown has a crown shaft portion passed through the hole and a crown head portion continuous therewith. The crown shaft is provided with a lock groove continuous in the peripheral direction. The lock button accommodated in the mounting portion has a button head portion (operation end portion) protruding from the mounting portion. The button is movable between a lock position where it is engaged with the groove to constrain the crown and a lock canceling position where it is detached from the groove to cancel the constraint of the crown, and is arranged at the lock canceling position through a one-touch operation of the button head portion. The watch is characterized in that the button is arranged at the lock position by an urging member accommodated in the mounting portion.

9 Claims, 13 Drawing Sheets

PORTABLE WATCH

BACKGROUND OF THE INVENTION

Field of the Invention

The present invention relates to a portable watch such as a wristwatch or a pocket watch equipped with a structure helping to prevent an erroneous operation of a crown while the watch is being carried about.

In a wristwatch, it is required that the crown should be prevented from being erroneously operated while the watch is being carried about, that is, that the crown should be prevented from being erroneously pulled out and rotated inadvertently.

For this purpose, there is known as a prior-art technique capable of locking the crown, a watch in which a male screw portion is provided in the outer periphery of a tubular protrusion protruding to the case band exterior side of a winding stem pipe fixed to the case band, in which the crown is formed by a shaft portion inserted into the winding stem pipe and a crown head portion capable of receiving the tubular protrusion and equipped with a female screw portion, and in which a coil spring is arranged between the shaft portion and the crown head portion, with the female screw portion of the crown head portion being threadedly engaged with the male screw portion of the tubular protrusion to thereby make it possible to fix the crown to the winding stem pipe through threaded engagement (See, for example, Patent Document 1).

Apart from this, as a prior-art technique capable of locking the crown, there is known a watch in which a male screw portion is provided in the outer periphery of a tubular protrusion protruding to case band exterior side of a winding stem pipe fixed to the case band, with a stop ring being mounted thereto, in which a shaft portion of a crown having the shaft portion and a crown head portion integral therewith is inserted into the winding stem pipe, in which a female screw portion of a protector having a protection frame portion capable of receiving the crown head portion and the female screw portion is threadedly engaged with the male screw portion of the tubular protrusion, and in which the protector is provided so as to be movable between a protecting position where it is placed in position by the stop ring and arranged so as to surround the crown head portion and a standby position where it is arranged so as to expose the crown head portion, with an inadvertent crown operation being prevented through arrangement of the protector at the protecting position (See, for example, JP-A-2000-329867).

SUMMARY OF THE INVENTION

In the prior-art technique disclosed in Patent Document 1, in both preventing an erroneous operation of the crown and enabling the operation of the crown, it is necessary to take the trouble to rotate the crown head portion or the protector protecting this crown head portion, resulting in a rather poor operability. Further, with the watch remaining attached to the arm, the arm is likely to constitute an obstruction to the operation of rotating the crown head portion or the protector, so that, to secure the requisite operation space for the finger to rotate the crown, etc., the user is generally obliged to detach the watch from his arm, which also leads to a rather poor operability.

As described above, the prior-art technique has a problem in that its operability for enabling the operation of preventing an erroneous operation of the crown and enabling the operation of the crown, is rather poor.

To solve the above problem, according to the present invention, there are provided a watch exterior member which is equipped with a case band and which has a crown mounting hole formed so as to extend radially through the case band and a member mounting portion communicating with a portion of the crown mounting hole offset from a central portion of the crown mounting hole, vertically perpendicular to the crown mounting hole, and formed in the case band so as to be open at an upper end; a crown which has a crown shaft equipped with a peripherally continuous lock groove and a crown head portion continuous with this shaft and which is arranged with the crown shaft inserted into the crown mounting hole; a crown lock member which has an operation end portion protruding from the open upper end of the member mounting portion and is accommodated in the member mounting portion, which is movable between a lock position where it is engaged with the lock groove to constrain the crown and a lock canceling position where it is off the lock groove and cancels the constraint of the crown, and which is arranged at the lock canceling position through a one-touch operation of the operation end portion; and an urging member accommodated in the member mounting portion and urging the crown lock member so as to arrange it at the lock position.

In the present invention, the expression: "the central portion of the crown mounting hole" indicates the central portion of the hole section taken in a direction orthogonal to the center axis of this mounting hole. Thus, in the present invention, the expression that the member mounting portion communicates with a position off the central portion of the crown mounting hole means that the member mounting portion communicates with the peripheral portion of the hole section of the crown mounting hole.

In the present invention, the member mounting portion may be formed as a through-hole or a bottomed hole, and it is desirable for the hole section taken in the direction orthogonal to the center axis of the member mounting portion to be circular from the viewpoint of facilitating the machining of the member mounting portion with respect to the case band, which, however, should not be construed restrictively. In the present invention, it is also desirable that the section of the crown lock member taken in the direction orthogonal to the axial direction thereof be circular in facilitating the machining, which, however, should not be construed restrictively; a crown lock member in conformity with the configuration of the hole section of the member mounting portion may be adopted.

In the present invention, the one-touch operation of the operation end portion means the operation of simply pressing down the crown lock member without allowing the crown lock member to rotate around the center axis thereof or the operation of simply tilting the crown lock member. In the present invention, it is possible to suitably use a coil spring or a plate spring as the urging member; however, it is also possible to use some other material capable of elastic deformation such as rubber or elastomer. In the present invention, the crown shaft may be formed of a single shaft member of an integral structure or formed of a combination of a plurality of shaft members.

In the portable watch of the present invention, the crown lock member is arranged at a lock position by the urging force of the urging member, and this lock member is retained in a state in which it is engaged with the lock groove of the crown. Thus, even if, while the portable watch is being carried about, there is applied a force directed to the case band exterior side of the crown, the crown is not erroneously pulled out, and, consequently, it is possible to prevent erroneous rotation of the crown.

In the portable watch of the present invention, for the user to operate the crown when, for example, performing time correction, a finger of the user is first applied to the operation end portion of the crown lock member protruding upwardly from the case band, and the crown lock member is moved to the lock canceling position from the lock position through a one-touch operation such as simple pushing-in of the crown lock member without involving any rotating operation. As a result, the crown lock member is detached from the lock groove of the crown, making it possible to move the crown in the axial direction. Thus, in this state, the user can apply his fingers to the crown head portion and pull out the crown to perform operation thereon.

After this operation of the crown, the crown is pushed in through a one-touch operation by the user. As a result, the lock groove of the crown is opposed to the crown lock member and, with this, the crown lock member is engaged with the lock groove by the urging force of the urging member, whereby the crown is retained so as not to be erroneously pulled out.

As described above, in the present invention, the prevention of an erroneous operation of the crown can be realized through a one-touch pushing-in operation of the crown, and the enabling of the operation of the crown can be realized through a one-touch operation of the crown lock member, so that it is possible to attain a satisfactory operability in both cases.

In a preferred mode of the present invention, the crown lock member consists of a crown lock button that can be downwardly pushed in, and this lock button has an engagement shaft portion that is engaged with the lock groove at the lock position and that is arranged at the lock canceling position away from the movement path of the crown shaft, and an escape shaft portion continuous with the upper side of this shaft portion and arranged at the lock canceling position away from the movement path of the crown shaft.

In this preferred mode, the crown lock member consists of a crown lock button, so that the operation of the crown can be made possible through the one-touch operation of pushing this in downwardly. That is, the crown lock button is pushed in downwardly from the lock position, whereby the engagement shaft portion and the escape shaft portion thereof are arranged at the lock canceling positions while offset from the movement path of the crown shaft so that they may not constitute an obstruction to the crown pulling-out operation. And, when, after the operation of the crown, the crown is pushed in through a one-touch operation, the lock groove of the crown is opposed to the crown lock member and, with this, the crown lock member is pushed up by the urging force of the urging member, and the engagement shaft thereof is engaged with the lock groove, retaining the crown so as to prevent it from being erroneously pulled out.

As described above, in this preferred mode, the prevention of an erroneous operation of the crown and the enabling of the operation of the crown can be realized through a one-touch pushing-in operation of the crown and a one-touch pushing-in operation of the crown lock member, resulting in a satisfactory operability.

In a preferred mode of the present invention, the crown lock member is a crown lock lever that can be tilted so as to move toward and away from the crown shaft around the lower end portion thereof.

In this preferred mode, the crown lock member consists of a tiltable crown lock lever, so that the operation of the crown can be made possible through a one-touch operation of tilting this. That is, the crown lock lever arranged at the lock position is tilted away from the crown shaft, whereby this lever is arranged at the lock canceling position while spaced apart from the movement path of the crown shaft so that it may not constitute an obstruction to the operation of pulling out the crown. And, when, after the operation of the crown, the crown is pushed in by a one-touch operation, the lock groove of the crown is opposed to the crown lock lever and, with this, the crown lock lever is pushed back by the urging force of the urging member so as to be brought into contact with the crown shaft and is engaged with the lock groove, so that the crown is retained so as not to be erroneously pulled out.

As described above, in this preferred mode, the prevention of an erroneous operation of the crown and the enabling of the operation of the crown can be realized through a one-touch push-in operation of the crown and a one-touch operation of tilting the crown lock lever constituting the crown lock member, so that a satisfactory operability is obtained.

In a preferred mode of the present invention, even in the state in which the crown has been pulled out to a maximum degree, the lock groove is arranged within the crown mounting hole, and shaft portions of the crown shaft continuous with both sides of the lock groove are supported by the inner surface of the crown mounting hole.

In this preferred mode, despite the fact that the strength of the crown shaft is reduced by the lock groove provided in the crown shaft, a pair of shaft portions continuous with both sides of the lock groove are supported by the inner surface of the crown mounting hole. Thus, even if the portable watch is dropped with the crown pulled out to a maximum degree, the resultant impact can be supported by the case band via the pair of shaft portions. As a result, the impact is not concentrated on the portion between the pair of shaft portions, so that there is no fear of the crown shaft being deformed.

In a preferred mode of the present invention, the crown shaft is equipped with a first shaft member connected to the winding stem and having a lock protrusion, and a second shaft member having a surrounding end portion receiving the first shaft member and the lock groove, continuous with the crown head portion, and having in the surrounding end portion a lock groove allowing sliding of the lock protrusion, with an urging body urging the second shaft member toward the case band exterior side being held in a compressed state between the two shaft members.

In this preferred mode, the crown lock member is arranged at the lock canceling position to enable the operation of the crown and, with this, the second shaft member of the crown and the crown head portion continuous therewith are pushed out toward the case band exterior side by the urging force of the urging body held in a compressed state between the first and second shaft members. In this case, the first shaft member does not move, so that the engagement groove of the second shaft member slides with respect to the lock protrusion thereof, thereby effecting the above-mentioned pushing-out operation. This makes it easier for the user to grasp the crown head portion with his fingers, so that the crown operations such as further extraction of the crown and the rotation thereof afterwards are facilitated. When the crown head is rotated with the crown pulled out, its rotation is transmitted to the first shaft member via the engagement portion between the engagement groove and the lock protrusion, whereby time correction, etc. are effected. Further, when the crown is pushed in, the surrounding end portion receives the first shaft member more deeply, with the engagement groove sliding on the lock protrusion, so that the urging body is compressed. And, when the pushing-in of the crown is completed, the crown lock member is engaged with the lock groove of the crown at this point in time, so that the urging body is maintained in the compressed state.

In the preferred mode of the present invention, the section of the crown lock button taken in a direction orthogonal to the axial direction is circular, and the urging force of the urging body is the same as or smaller than the urging force of the urging member.

In this preferred mode, the section of the crown lock button is circular, so that the machining for forming the crown lock button, and the machining for forming, in the case band, the member mounting portion accommodating the crown lock button, are facilitated. Thus, despite the possibility of the crown lock button of a circular section rotating within the member mounting portion, there is no fear of the crown lock button being rotated by the force of the urging body, with the result that the crown can be prevented from further inadvertently protruding to the case band exterior side.

In a preferred mode of the present invention, the member mounting portion has an upper hole portion whose upper end is open, a lower hole portion whose lower end is open, and an intermediate hole portion whose diameter is smaller than that of the upper and lower hole portions and which communicates with the crown mounting hole; the crown lock button has the engagement shaft portion sliding in the intermediate hole portion, the escape shaft portion, and a button head portion continuous with the upper side of the escape shaft portion and capable of retracting into the upper hole portion; the urging member is provided between the button head portion and the bottom of the upper hole portion; and a stopper moving toward and away from the bottom of the lower hole portion is mounted to the lower end portion of the engagement shaft portion.

In this preferred mode, the member mounting portion is provided so as to extend vertically through the case band, so that, as compared with the case in which a bottomed hole is formed in the case band by machining, the machining of the member mounting portion with respect to the case band is easier. Further, despite the fact that the crown lock button accommodated in this member mounting portion is upwardly urged by the urging member, it is possible to prevent this crown lock button from being detached upwardly due to the stopper. At the same time, the stopper does not prevent downward movement of the crown lock button, so that it is possible to arrange the crown lock button at the lock canceling position through a one-touch press-down operation.

In a preferred mode of the present invention, a cap closing the lower hole portion is mounted to the case band, and this cap is arranged higher than the surface of the case back of the watch exterior member.

In the portable watch of this preferred mode, when it is used while attached to the hand of the user, it is possible to suppress the discomfort because of the cap closing the lower hole portion being strongly held in contact with the hand skin, thus providing a satisfactory using comfort.

In a preferred mode of the present invention, a protrusion is formed on the case band in correspondence with the 3 o'clock side of the dial arranged on the inner side of the case band, and the crown lock member and the urging member are arranged on this protrusion.

In this preferred mode, it is possible to provide the crown lock member and the urging member on the case band without having to form the case as a whole in a large diameter.

In the portable watch of the present invention, it is possible to achieve an improvement in terms of operability in performing the operation of preventing an erroneous operation of the crown and in enabling the operation of the crown.

DETAILED DESCRIPTION OF THE PREFERRED EMBODIMENTS

In the following, the first embodiment of the present invention will be described in detail with reference to FIGS. 1 through 9.

Figure 1:
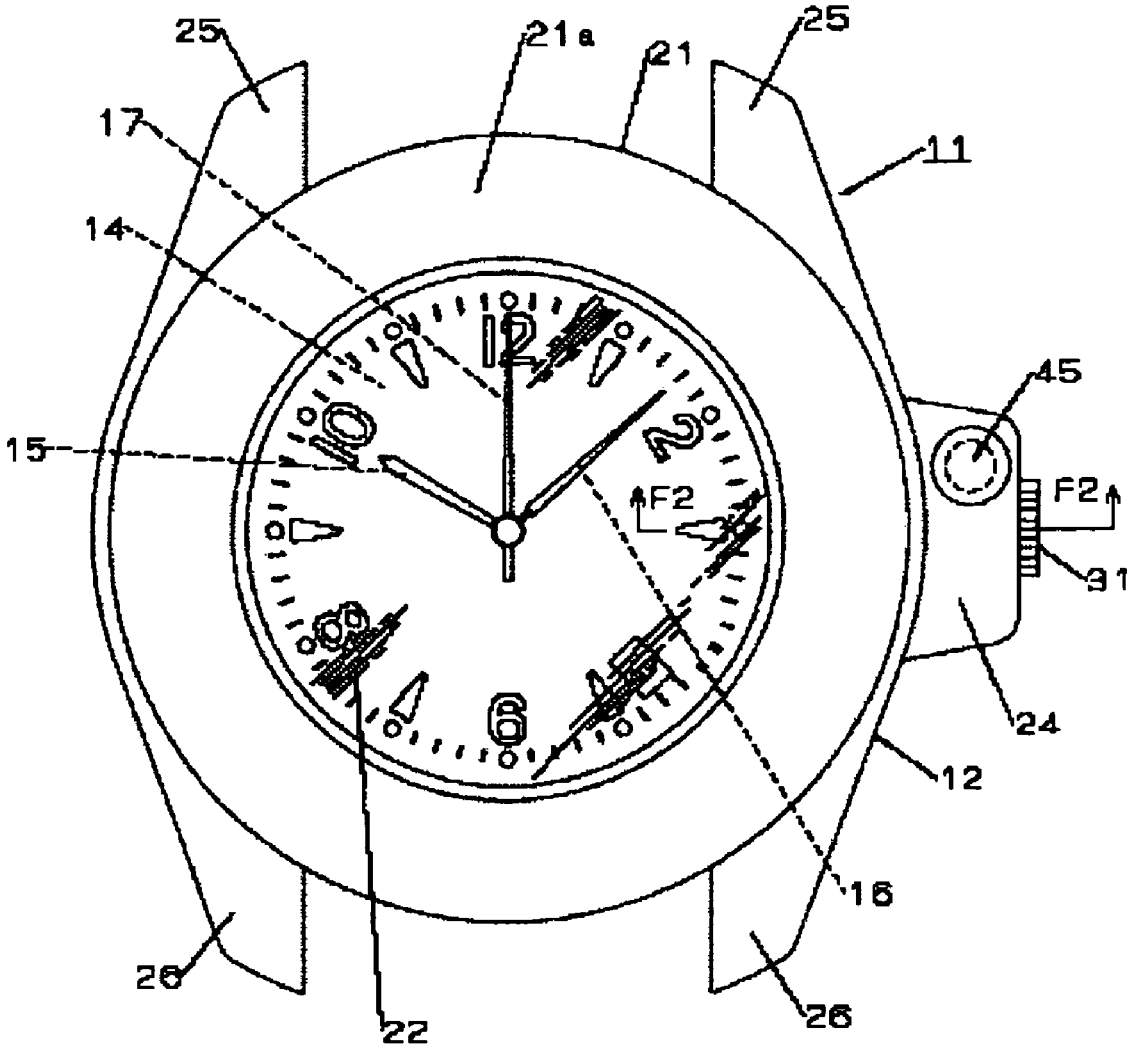
FIG. 1 is a front view of a wristwatch according to a first embodiment of the present invention with a crown lock button thereof at a lock position.
Figure 2:
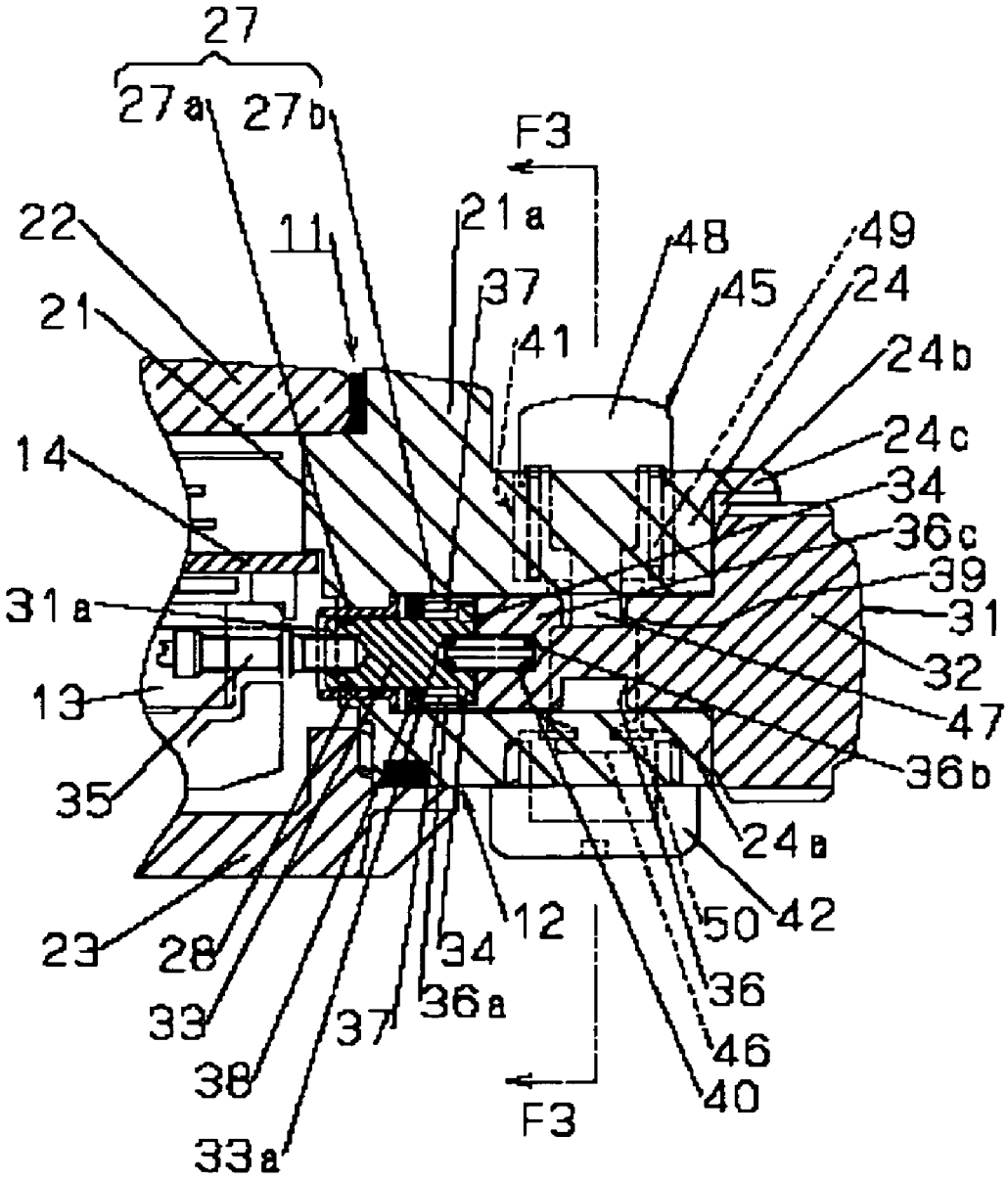
FIG. 2 is a sectional view taken along the line F2-F2 of FIG. 1.
Figure 5:
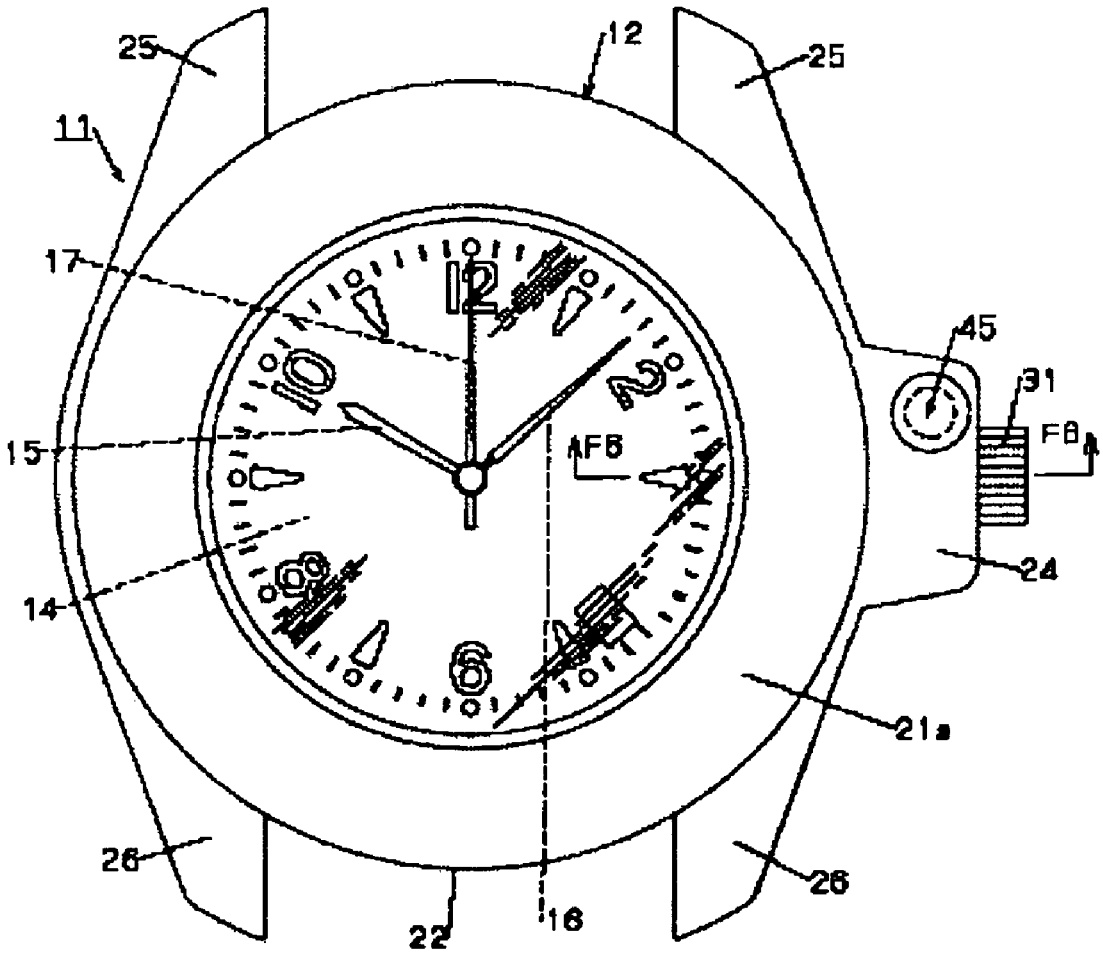
FIG. 5 is a front view of the wristwatch of the first embodiment of the present invention with the crown lock button thereof at a lock canceling position.
Figure 6:
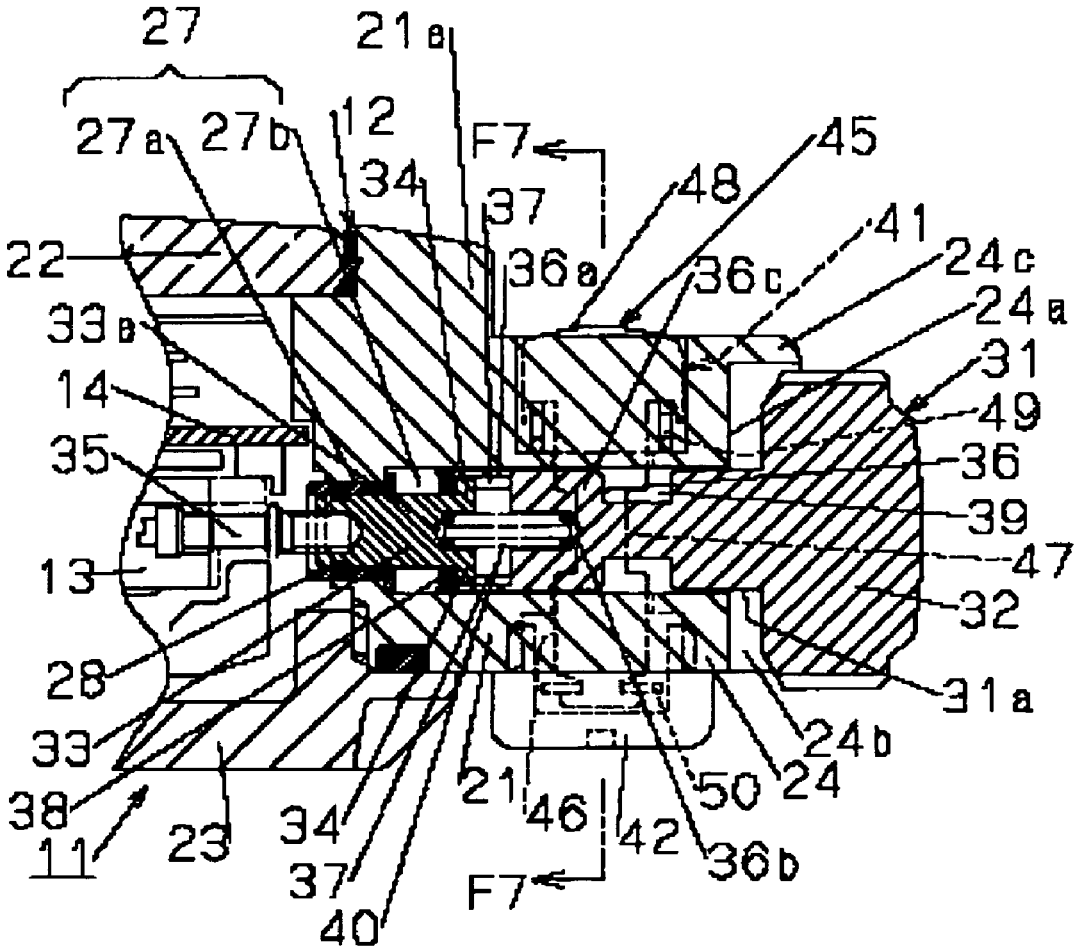
FIG. 6 is a sectional view taken along the line F6-F6 of FIG. 5.

In FIGS. 1, 2, 5, and 6, numeral 11 indicates a portable watch such as a wristwatch. As shown in FIGS. 2 and 6, inside a watch exterior member 12 of the wristwatch 11, there are provided a built-in component such as a watch movement 13 and a time display portion such a circular dial 14. The display on the dial 14 is effected by time indicating hands driven by the watch movement 13, more specifically, by a short hand 15, a long hand 16, and a minute hand 17 shown in FIGS. 1 and 5.

As shown in FIGS. 2 and 6, the watch exterior member 12 is equipped with a case band 21, a glass 22, and a case back 23. The case band 21 is formed in an annular shape of a metal such as stainless steel or titanium or synthetic resin. The glass 22 allowing the dial 14 to be viewed from the outside is attached liquid-tight to the front portion of the case band 21. The case back 23 is formed of metal or synthetic resin, and is attached liquid-tight so as to close the back side of the case band 21.

As shown in FIGS. 1 and 5, the case band 21 has an annular portion 21*a* surrounding the periphery of the dial 14 as seen from the front side, a protrusion 24, a pair of bow legs 25, and another pair of bow legs 26.

The annular portion 21*a*, which is integral with the case band 21, is circular, and the glass 22 is attached to the inner peripheral portion thereof. As shown in FIGS. 2 and 6, the protrusion 24 protrudes integrally from the 3 o'clock side of the dial 14. The upper surface of the protrusion 24 is at a position lower than the upper end of the annular portion 21*a*, and the lower surface of the protrusion 24 is at a position higher than the surface (lower surface) of the case back 23. The protrusion 24 has a crown receiving surface 24*a* perpendicular to the forward end portion thereof, and has a crown cover portion 24*c* forming a recess 24*b* whose bottom is the crown receiving surface 24*a*. The lower end of the recess 24*c* is open in the lower surface of the protrusion 24. The crown cover portion 24*c* and the recess 24*c*, which protect a crown 31 from the outer periphery thereof, may be omitted. The bow legs 25 protrude integrally from the upper portion of the case band 21 as seen in FIGS. 1 and 5, an the other bow legs 26 protrude integrally from the lower portion of the case band 21 as seen in FIGS. 1 and 5; an arm attachment member such as a belt (not shown) is mounted to these bow legs.

The case band 21 has a crown mounting hole 27 formed so as to radially extend therethrough. The crown mounting hole 27 is provided on the 3 o'clock time display side of the dial 14. The crown mounting hole 27 is composed of a small diameter hole portion 27*a* and a large diameter hole portion 27*b* continuous therewith. The small diameter hole portion 27*a* is open to the interior of the case band 21, and the large diameter hole portion 27*b* is open to the crown receiving surface 24*a*. The inner surface of the small diameter hole portion 27*a* is covered with a winding stem pipe 28 fixed to the small diameter hole portion 27*a*.

The metal crown 31 is mounted to the crown mounting hole 27. As shown in FIGS. 2, 4, 6, 8, and 9, the crown is equipped with a crown shaft 31*a* and a crown head portion 32 continuous therewith, and the crown shaft 31*a* is composed of a first shaft member 33 and a second shaft member 36.

The section of the first shaft member 33 taken in a direction orthogonal to the center axis is circular. The first shaft member 33 is inserted into the winding stem pipe 28 from the large diameter hole portion 27*b* side toward the interior of the case band 21. A plurality, for example, a pair of lock protrusions 34 protrude integrally from the outer periphery of the end portion of the first shaft member 33 situated inside the large diameter hole portion 27*b*. The lock protrusions 34 are spaced apart from each other by 180° in the peripheral direction of the first shaft member 33. Further, at the end portion of the first shaft member 33 situated inside the large diameter hole portion 27*b*, there is provided a hole 33*a* in the end surface thereof.

A winding stem 35 is connected to the first shaft member 33 from the case band interior side. The winding stem 35 is connected to the watch movement 13. The operation of the crown 31 is transmitted to the watch movement 13 via the winding stem 35, whereby time correction, calendar date correction, etc. are effected.

The second shaft member 36 protrudes integrally from the central portion of the crown head portion 32. The second shaft member 36 is slidably inserted into the large diameter hole portion 27*b* from the case band exterior side, and has a surrounding end portion 36*a* at the forward end portion thereof. The surrounding end portion 36*a* is capable of receiving the end portion of the first shaft member 33 provided with the hole 33*a*.

The surrounding end portion 36*a* is provided with lock grooves 37 open in the inner peripheral surface thereof, and a stop ring 38 is fixed thereto. The lock grooves 37 are formed in the same number as the lock protrusions 34, and extend in the axial direction of the second shaft member 36. The stop ring 38 is fixed to the opening end of the surrounding end portion 36*a*, closing the ends of the lock grooves 37.

The second shaft member 36 is provided with a hole 36*b* open to the inner space of the surrounding end portion 36*a*. The hole 36*b* is opposed to the hole 33*a* of the first shaft member 33. The second shaft member 36 has a lock groove 39 formed in an intermediate portion in the axial direction thereof. The lock groove 39 is formed so as to be continuous in the peripheral direction of the second shaft member 36. The section of the portion of the second shaft member 36 other than the surrounding end portion 36*a* taken in the direction orthogonal to the center axis is circular. The diameter of shaft portions 36*c*, 36*d* continuous with both sides of the lock groove 39 is substantially equal to the diameter of the large diameter hole portion 27*b*.

The second shaft member 36 is slidably inserted into the large diameter hole portion 27*b* from the case band exterior side. The first shaft member 33 is received in the surrounding end portion 36*a* thereof, and the lock grooves 37 are slidably engaged with the lock protrusions 34. As a result, the crown 31 is mounted to the watch exterior member 12 in correspondence with the 3 o'clock time display side of the dial 14.

The crown 31 has an urging body 40 consisting, for example, of a coil spring. The two end portions of the urging body 40 are inserted into the holes 33*a*, 36*b*, and is provided in a compressed state between the first shaft member 33 and the second shaft member 36, urging the second shaft member 36 toward the case band exterior. If the crown 31 is rotated, with the crown 31 being arranged at the pulled-out standby position shown in FIG. 2, the rotational force thereof exerts no action on the watch movement 13. At the same time, the end surface of the first shaft member 33 of the crown 31 arranged at the pulled-out standby position is in contact with or close to the bottom of the surrounding end portion 36*a*, so that the urging body 40 is in the compressed state. Further, the crown 31 arranged at the pulled-out standby position is retained in a state in which the back surface of the crown head portion 32 thereof is in contact with the crown receiving surface 24*a* of the case band 21.

Figure 3:
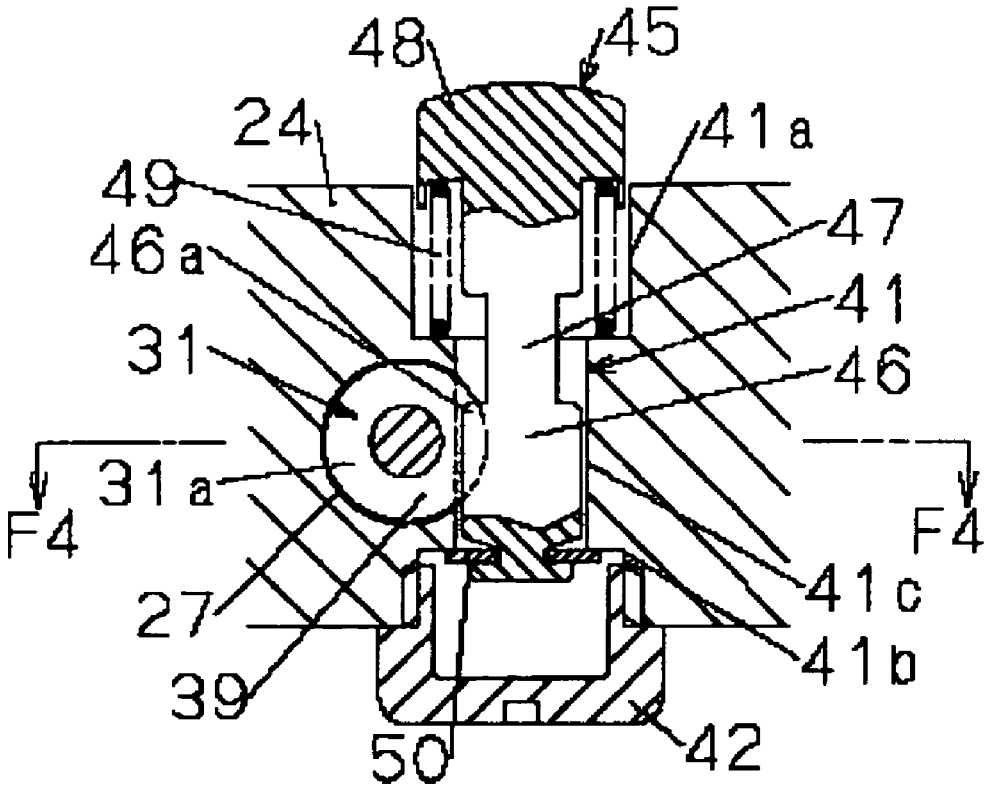
FIG. 3 is sectional view taken along the line F3-F3 of FIG. 2.
Figure 7:
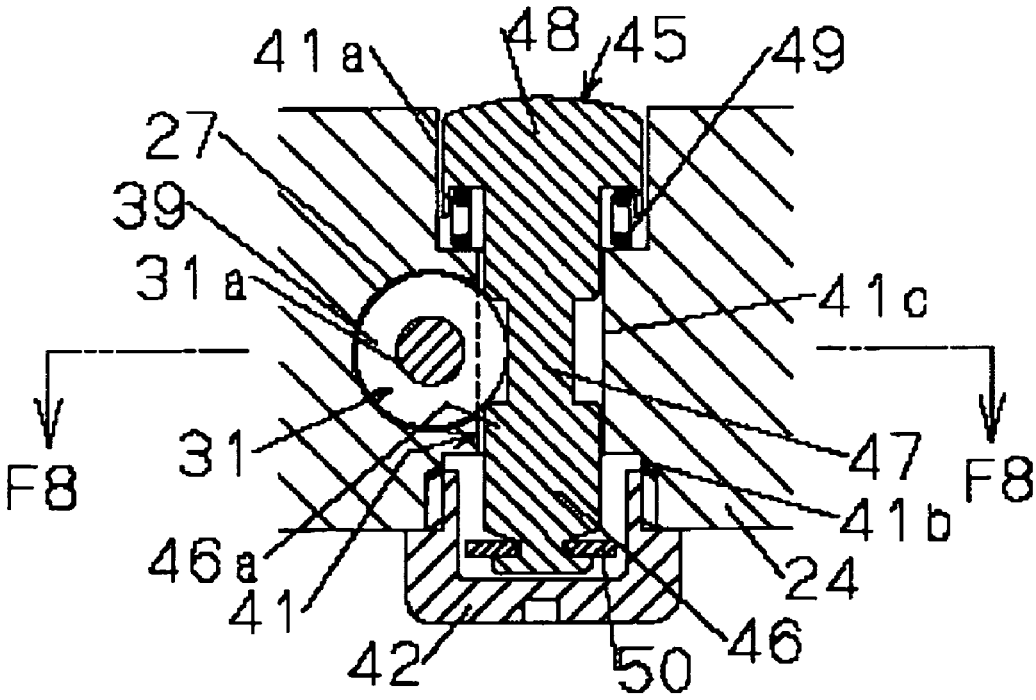
FIG. 7 is a sectional view taken along the line F7-F7 of FIG. 6.

The case band 21 has a member mounting portion 41. As shown in FIGS. 3 and 7, the member mounting portion 41 is provided in the vicinity of the crown mounting hole 27, and has an upper hole portion 41*a*, a lower hole portion 41*b*, and an intermediate hole portion 41*c*. The upper hole portion 41*a* is open in the upper surface of the protrusion 24, and the section taken in a direction orthogonal to the center axis thereof is circular. The lower hole portion 41*b* is open in the lower surface of the protrusion 24, and the section taken in a direction orthogonal to the center axis thereof is circular. The lower hole portion 41*b* is of the same diameter as, for example, the upper hole portion 41*a*. The intermediate hole portion 41*c* is provided so as establish communication between the upper hole portion 41*a* and the lower hole portion 41*b*. The section of the intermediate hole portion 41*c* taken in a direction orthogonal to the center axis thereof is circular, and its diameter is smaller than the diameter of the upper hole portion 41*a* and the lower hole portion 41*b*.

Figure 4:
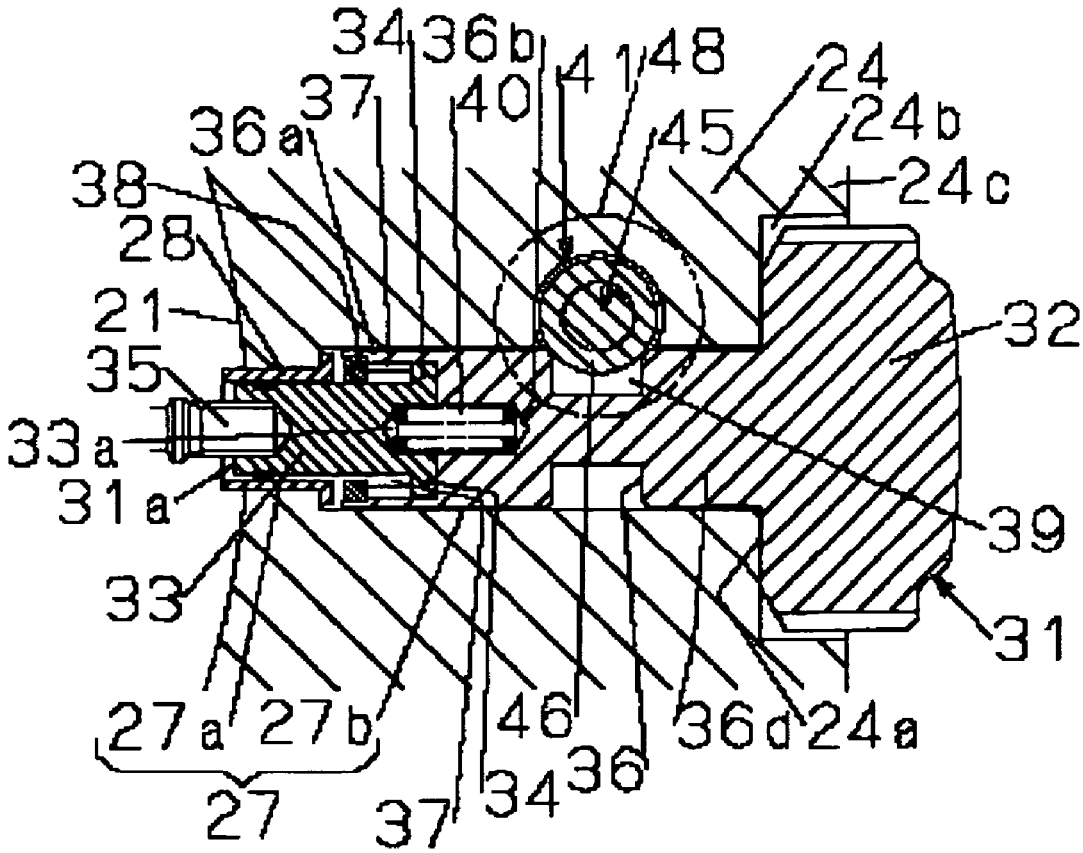
FIG. 4 is a sectional view taken along the line F4-F4 of FIG. 3.

The center axes of the upper hole portion 41*a*, the lower hole portion 41*b*, and the intermediate hole portion 41*c* constitute the center axis of the member mounting portion 41, and are vertically continuous in a straight line. Thus, the member mounting portion 41 is formed as a stepped hole vertically extending through the protrusion 24. As shown in FIGS. 3, 4, etc., the intermediate hole portion 41*c* of the member mounting portion 41 communicates with the peripheral portion of the large diameter hole portion 27*b* of the crown mounting hole 27. In other words, the member mounting portion 41 is vertically orthogonal with respect to the crown mounting hole 27, and is formed so as to communicate with a portion of the crown mounting hole 27 off the central portion thereof. The upper hole portion 41*a* and the lower hole portion 41*b* of the member mounting portion 41 are vertically off the crown mounting hole 27.

A cap 42 closing the opening at the lower end of the lower hole portion 41*b* of the member mounting portion 41 is threaded into the protrusion 24 of the case band 21. The lower surface of the cap 42 resides at a position higher than a surface 23*a* of the case back 23.

A metal crown lock member such as a crown lock button 45 is mounted to the protrusion 24 of the case band 21 so as to allow downward pushing-in.

That is, as shown in FIGS. 2, 3, etc., the crown lock button 45 has an engagement shaft portion 46, an escape shaft portion 47, and a button head portion 48, the section of all of which taken in a direction orthogonal to the axial direction thereof is circular. The engagement shaft portion 46 is substantially of the same diameter as the intermediate hole portion 41*c*. The button head portion 48 has a large diameter portion and a small diameter shaft portion protruding from the back side thereof. The large diameter portion of the button head portion 48 is substantially of the same diameter as the upper hole portion 41*a*, and the small diameter portion of the button head portion 48 is substantially of the same diameter as the intermediate hole portion 41*c*. The escape shaft portion 47 is continuous with the upper side of the engagement shaft portion 46, and the engagement shaft portion 46 and the small diameter shaft portion of the button head portion 48 are integrally continuous with each other. The diameter of the escape shaft portion 47 is smaller than that of the small diameter shaft portion of the engagement shaft portion 46 and the button head portion 48, whereby the escape shaft portion 47 never crosses the crown 31.

The crown lock button 45 is accommodated in the member mounting portion 41 so as to be vertically movable, and the engagement shaft portion 46 is slidably fit-engaged with the intermediate hole portion 41*c*. An urging member 49 consisting of a coil spring is provided in a compressed state between the large diameter portion of the button head portion 48 and the bottom of the upper hole portion 41*a*. Due to the urging force of the urging member 49, the crown lock button 45 protrudes upwardly from the open upper end of the upper hole portion 41*a*. In other words, the crown head lock button 45 is provided so as to allow downward pressing-in. And, to prevent upward detachment of the crown lock button 45, a stopper 50 is mounted to the lower end portion of the engagement shaft portion 46. The stopper 50 can move toward and away from the bottom of the lower hole portion 41*b* as the crown lock button 45 moves vertically. The stopper 50 is hidden behind the cap 42.

The crown lock button 45 is movable between a lock position and a lock canceling position. FIG. 3 shows a state in which the crown lock button 45 has been pushed up by the urging member 49 to be arranged at the lock position, and FIG. 7 shows a state in which the crown lock button 45 has been pushed down to be arranged at the lock canceling position.

Normally, except when the crown 31 of the wristwatch 11 is operated, the crown lock button 45 is arranged at the lock position. And, in this state, as shown in FIG. 3, the upper portion of the engagement shaft portion 46 of the crown lock button 45 has been upwardly inserted from below into the communicating portion of the crown mounting hole 27 and the member mounting portion 41. Thus, the engagement shaft portion 46 crosses the movement path of the second shaft member 36 of the crown 31, with this crossing portion having entered the lock groove 39 of the second shaft member 36 as shown in FIG. 4.

Due to this engagement, the crown 31 is retained at the pulled-out standby position, and the crown 31 is constrained so that it cannot move in the axial direction thereof. Thus, if a pulling-out force is applied to the crown 31 thus constrained, the crown 31 is prevented from being inadvertently pulled out toward the case band exterior.

Next, the procedures for pulling out the crown 31 to a 1st step position or a 2nd step position for its operation will be illustrated.

First, the crown lock button 45 is pushed down to the lock canceling position shown in FIG. 7. This can be effected through a one-touch operation. As a result, the engagement shaft portion 46 of the crown lock button 45 is moved to a position below the communicating portion of the crown mounting hole 27 and the member mounting portion 41, and the engagement shaft portion 46 is detached from the lock groove 39 of the second shaft member 36 to get off the movement path of the second shaft member 36 of the crown 31. In this case, the small diameter portion of the button head portion 48 is inserted into the intermediate hole portion 41*c* of the member mounting portion 41 from above; the small diameter portion of the button head portion 48 stays at a position off the movement path of the second shaft member 36 even in the state in which the crown lock button 45 has been pressed down to a maximum degree. Further, in any state, the escape shaft portion 47 is arranged off the movement path of the second shaft member 36. Thus, through the one-touch pressing down of the crown lock head 45, the constraint of the crown 31 by the crown lock button 45 is canceled.

Figure 8:
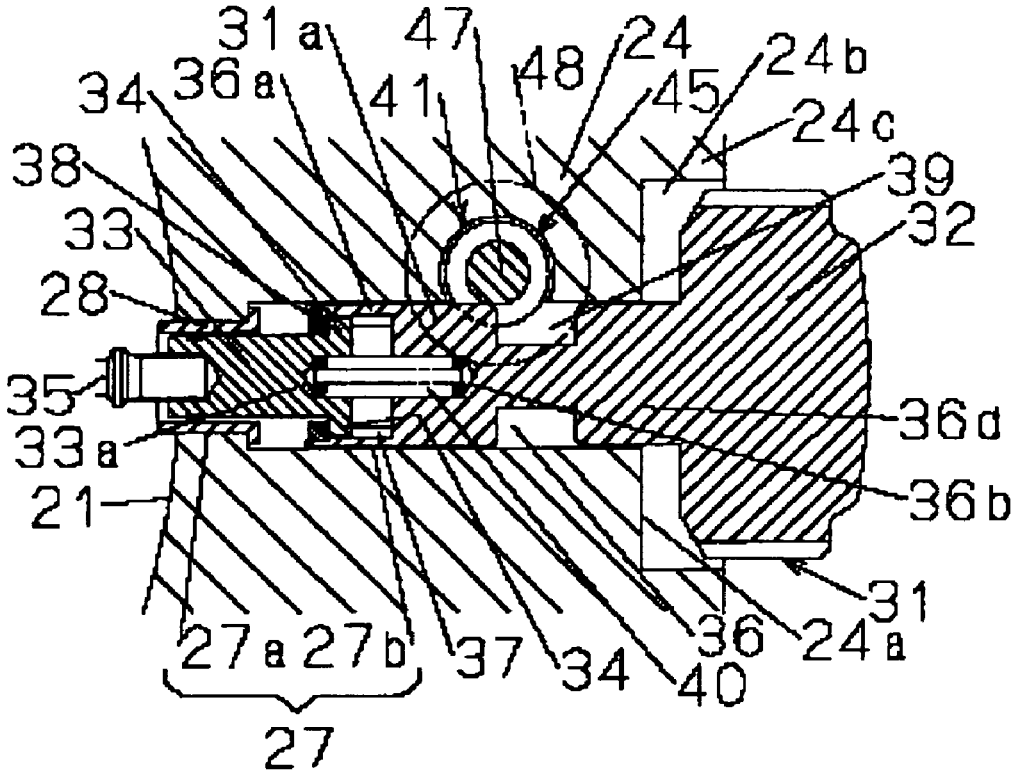
FIG. 8 is a sectional view taken along the line F8-F8 of FIG. 7.

Through this lock canceling, a state is attained in which axial movement of the crown 31 is possible. Thus, as the second shaft member 36 and the crown head portion 32 are pushed out automatically toward the case band exterior side by the urging force of the urging body 40, the crown head portion 32 is arranged at the 0th step, and the urging body 40 is expanded. FIG. 8 shows this state.

In this case, the first shaft member 33 is at rest, so that the lock grooves 37 of the second shaft member 36 slide with respect to the lock protrusions 34 of the first shaft member 33 to effect the above-mentioned pushing-out operation. As a result, the stop ring 38 of the second shaft member 36 is maintained in the state in which it is caught by the lock protrusions 34 from the case band inner side.

Figure 9:
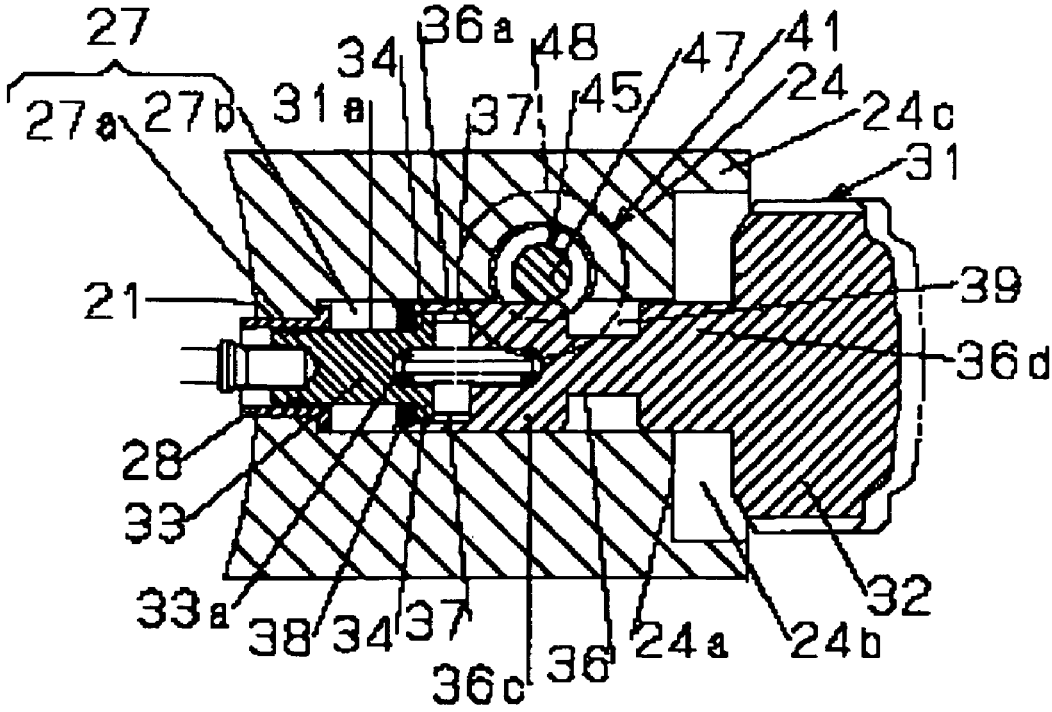
FIG. 9 is a sectional view, corresponding to FIG. 8, of the wristwatch of the first embodiment with the crown thereof pulled out one step.
Figure 10:
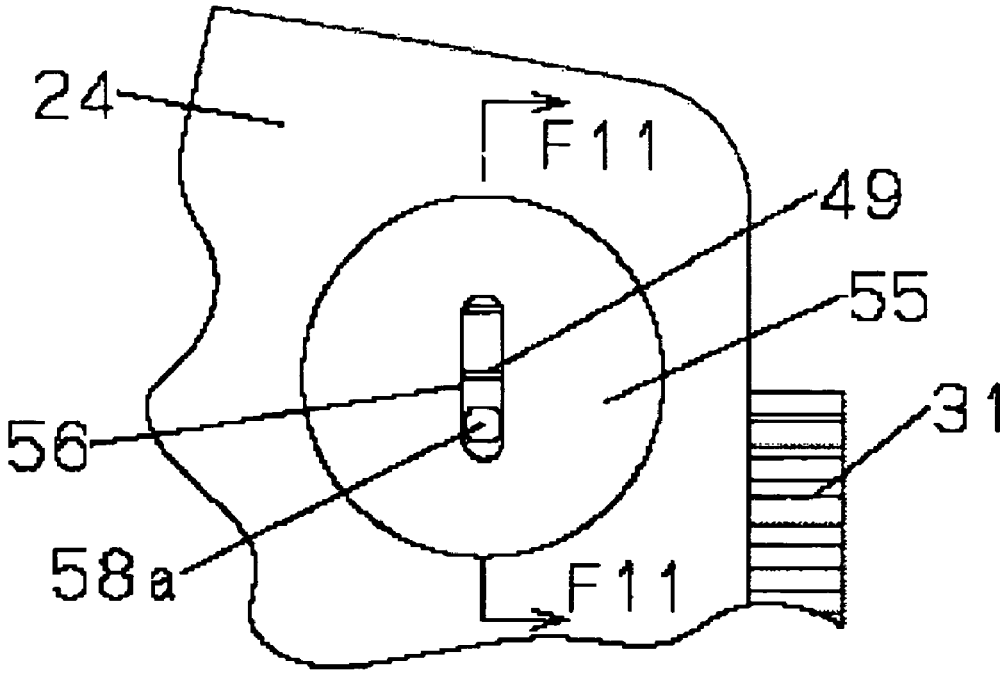
FIG. 10 is a partial front view of a wristwatch according to a second embodiment of the present invention with a crown lock lever thereof at a lock position.

At the same time, as shown in FIGS. 8 and 9, the shaft portion 36*c* continuous with the lock groove 39 on the left-hand side thereof enters the communicating portion of the crown mounting hole 27 and the member mounting portion 41 toward the case band exterior side. As a result, as shown in FIG. 7, the second shaft member 36 is engaged from above with the upper end corner (indicated by numeral 46*a*) of the engagement shaft portion 46 of the crown lock button 45. Thus, even if the crown lock button 45 is released from the hand, the crown lock button 45 is retained at the lock position.

When the crown 31 is pushed out to the 0th step position as described above, the crown cover portion 24*c* constitutes no obstruction to the grasping of the crown head portion 32 by the user, so that the crown 32 can be easily grasped by fingers to pull out the crown 31. In this case, due to the catch between the stop ring 38 and the lock protrusions 34, the first shaft member 33 follows the movement of the second shaft member 36. In FIG. 9, the state in which the crown 31 has been pulled out to the 1st step position is indicated by the solid line. When the crown 31 is further pulled out to the 2nd step position, the forward end of the crown head portion 32 is situated as indicated by the chain double-dashed line in FIG. 9.

And, the user rotates the crown 31, with the crown 31 thus pulled out to the 1st step or 2nd step position, whereby it is possible to effect time correction and calendar date correction. In this case, the rotation of the second shaft member 36 rotated integrally with the crown head portion 32 is transmitted to the first shaft member 33 due to the catch between the lock grooves 37 and the lock protrusions 34 and, at the same time, it is transmitted to the watch movement 13 via the winding stem 35. Further, as described above, in this crown operation, there is no need to continue to press the crown lock button 45 with the hand, so that it is possible to perform the above crown operation with the wristwatch 11 attached to the arm.

After the above crown operation, the crown 31 is pushed in through a one-touch operation against the urging force of the urging member 49 by the user. In this case, the surrounding end portion 36*a* receives the first shaft member 33 still more deeply with the lock grooves 37 sliding on the lock protrusions 34, so that the urging body 40 is compressed. When, through this pushing-in, the back surface of the crown head portion 32 abuts the crown receiving surface 24*a* of the case band 21, the shaft portion 36*c* of the second shaft member 36 is detached from the corner 46*a* at the upper end of the engagement shaft portion 46 of the crown lock button 45, and the lock groove 39 of the crown 31 is exactly opposed to the intermediate hole portion 41*c* of the member mounting portion 41.

Thus, at this point in time, the crown lock button 45 is pushed up to the lock position by the spring force of the urging member 49, and the engagement shaft portion 46 enters from below the communicating portion of the crown mounting hole 27 and the member mounting portion 41. As a result, as shown in FIG. 3, the engagement shaft portion 46 is engaged with the lock groove 39 of the second shaft member 36, and is arranged so as to cross the movement path of the second shaft member 36 of the crown 31. Thus, the crown 31 is retained at the pulled-out standby position shown in FIGS. 2 and 4. At the point in time when the pushing-in of the crown 31 has been thus completed, the crown lock button 45 is engaged with the lock groove 39 of the crown 31, so that the urging body 40 is maintained in the compressed state.

As described above, the retention of the crown 31 at the pulled-out standby position to prevent erroneous operation of the crown 31 can be realized through a one-touch push-in operation of the crown 31. At the same time, the extraction of the crown 31 and the enabling of its operation can be realized through a one-touch operation of the crown lock button 45, more specifically, a one-touch push-in operation of the crown lock button 45. Thus, a one-touch operation is possible in either case, which leads to a satisfactory operability.

The strength of the crown 31 of the wristwatch 11 is reduced by the lock groove 39 provided in the crown shaft 31*a*. However, as indicated by the chain double-dashed line in FIG. 9, even in the state in which the crown 31 is pulled out to a maximum degree, the lock groove 39 of the crown 31 is arranged within the crown mounting hole 27, and the shaft portions 36*c*, 36*d* of the crown shaft 31*a* continuous with both sides of the lock groove 39 are supported by the inner surface of the crown mounting hole 27. Thus, when the wristwatch 11 is dropped with the crown 31 pulled out to a maximum degree, it is possible to support the resultant impact with the case band 21 via the pair of shaft portions 36*c*, 36*d*. Thus, it is possible to prevent the above-mentioned impact from concentrating on the small diameter shaft portion of low strength between the pair of shaft portions 36*c*, 36*d*, so that there is no fear of deformation of the crown shaft 31*a*.

Further, since the section of the crown lock button 45 of the wristwatch 11 taken in a direction orthogonal to the axial direction thereof is circular, the machining for forming the crown lock button 45, and the machining for forming in the case band 21 the member mounting portion 41 in which the crown lock button 45 is accommodated, are facilitated. Under these conditions, the urging force of the urging body 40 is set to be equal to or smaller than the urging force of the urging member 49. Thus, despite the possibility of the crown lock button 45 of a circular sectional configuration rotating within the member mounting portion 41, it is possible to prevent rotation of the crown lock button 45 with the force of the urging body and, with this, it possible to prevent inadvertent protrusion of the crown 31 to the case band exterior side.

Further, the member mounting portion 41 of the wristwatch 11 has an upper hole portion 41*a* whose upper end is open, a lower hole portion 41*b* whose lower end is open, and an intermediate hole portion 41*c* of a smaller diameter than the upper and lower hole portions and communicating with the crown mounting hole 27. Thus, the member mounting portion 41 is provided so as to extend vertically through the case band 21, so that, as compared with the case in which a member mounting portion consisting of a bottomed hole is formed by machining in the case band 21, the machining of the member mounting portion 41 with respect to the case band 21 is easier.

At the same time, the crown lock button 45 of a circular sectional configuration accommodated in the member mounting portion 41 has an engagement shaft portion 46 sliding in the intermediate hole portion 41*c*, an escape shaft portion 47, and a button head portion 48 continuous with the upper side of the escape shaft portion 47 and retractable into the upper hole portion 41*a*. Thus, the crown lock button 45 can be formed by machining portions of different diameters on a columnar material, thus facilitating the machining of the crown lock button 45.

And, the urging member 49 is provided between the button head portion 48 and the bottom of the upper hole portion 41*a*, and, at the same time, there is provided at the lower end portion of the engagement shaft portion 46 a stopper 50 moving from below toward and away from the bottom of the lower hole portion 41*b*. The stopper 50 consists, for example, of a retaining ring mounting to the engagement shaft portion 46. Thus, despite the fact that the crown lock button 45 accommodated in the member mounting portion 41 is upwardly urged by the urging member 49, it is possible to prevent upward detachment of the crown lock button 45 due to the stopper 50. Further, the stopper 50 does not hinder downward movement of the crown lock button 45, so that it is possible to realize the pressing-down of the crown lock button 45 to the lock canceling position through a one-touch operation.

Further, a cap 42 closing the lower hole portion 41*b* is mounted to the back side of the case band 21, and the cap 42 is arranged so as to be higher than the surface of the case back 23 of the watch exterior member 12. Thus, when the wristwatch 11 is used while attached to the hand of the user, it is possible to suppress the discomfort because of the closed cap 42 closing the lower hole portion 41*b* coming into strong contact with the hand skin, thus providing a satisfactory comfort in use.

Further, a protrusion 24 is formed on the case band 21 of the wristwatch 11 in correspondence with the 3 o'clock side of the dial 14 arranged on the inner side thereof, and the crown lock button 45 and the urging member 49 are arranged on the protrusion 24. Thus, it is possible to provide the crown lock button 45 and the urging member 49 for locking the crown 31 at the pulled-out standby position as described above can be provided on the case band 21 without forming the case band 21 as a whole in a large diameter.

FIGS. 10 through 13 show a second embodiment of the present invention. Except for the construction of the member mounting portion, the crown lock member, the urging member, etc., the second embodiment is the same as the first embodiment inclusive of the construction not shown in FIGS.

10 through 13. In the following description, the components that are the same as those of the first embodiment are indicated by the same reference numeral as those of the first embodiment, and a description thereof will be omitted.

In the second embodiment, the member mounting portion 41 is formed as a bottomed round hole. The member mounting portion 41 crosses the crown mounting hole 27 in the thickness direction (vertical direction) of the case band, and the member mounting portion 41 and the crown mounting hole 27 communicate with each other at this crossing portion. The upper end of the member mounting portion 41 is open in the upper surface of the protrusion 24, and a plug 55 is attached to the protrusion 24 so as to close this opening portion.

The plug 55 has a rectangular guide hole 56. The guide hole 56 is formed to extend such that its longitudinal direction in plan view is orthogonal to the direction in which the protrusion 24 protrudes. Further, one end portion in the longitudinal direction of the guide hole 56 is provided directly above the crossing portion so as to be opposed to the crossing portion (communicating portion) from above.

In the second embodiment, the crown lock member is formed as a crown lock lever 58. The upper end portion of the crown lock lever 58 constitutes an operation end portion 58*a* thinner than the portion on the lower side thereof. The operation end portion 58*a* of the crown lock lever 58 extends through the guide hole 56, and is accommodated so as to be tiltable around the lower end portion of the crown lock lever 58. The tilting of the crown lock lever 58 is effected in the direction in which the crown shaft 31*a* of the crown moves toward and away from the second shaft member 36, and, with this tilting, the crown lock lever 58 can be detachably engaged with the lock groove 39. The operation end portion 58*a* is slidable in the guide hole 56, and, by pulling the operation end portion 58*a* along the guide hole 56 toward the 12 o'clock side of the wristwatch through a one-touch operation, it is possible to tilt the crown lock lever 58 and detach it from the lock groove 39. The portion of the crown lock lever 58 other than the operation end portion 58*a* is formed in a width larger than that of the guide hole 56 so that it may not be detached from the guide hole 56.

In the second embodiment, the urging member 49 consists of a plate spring of a substantially U-shaped or a substantially V-shaped configuration, and is accommodated in the member accommodating portion 41. The urging member 49 constantly urges the crown lock lever 58 toward the crown shaft 31*a*. Due to this urging, the crown lock lever 58 can be engaged with the lock groove 39 as the crown 31 is pushed through a one-touch operation. Except for the construction described above, this embodiment is of the same construction as the first embodiment inclusive of the portions not shown in FIGS. 10 through 13.

Figure 11:
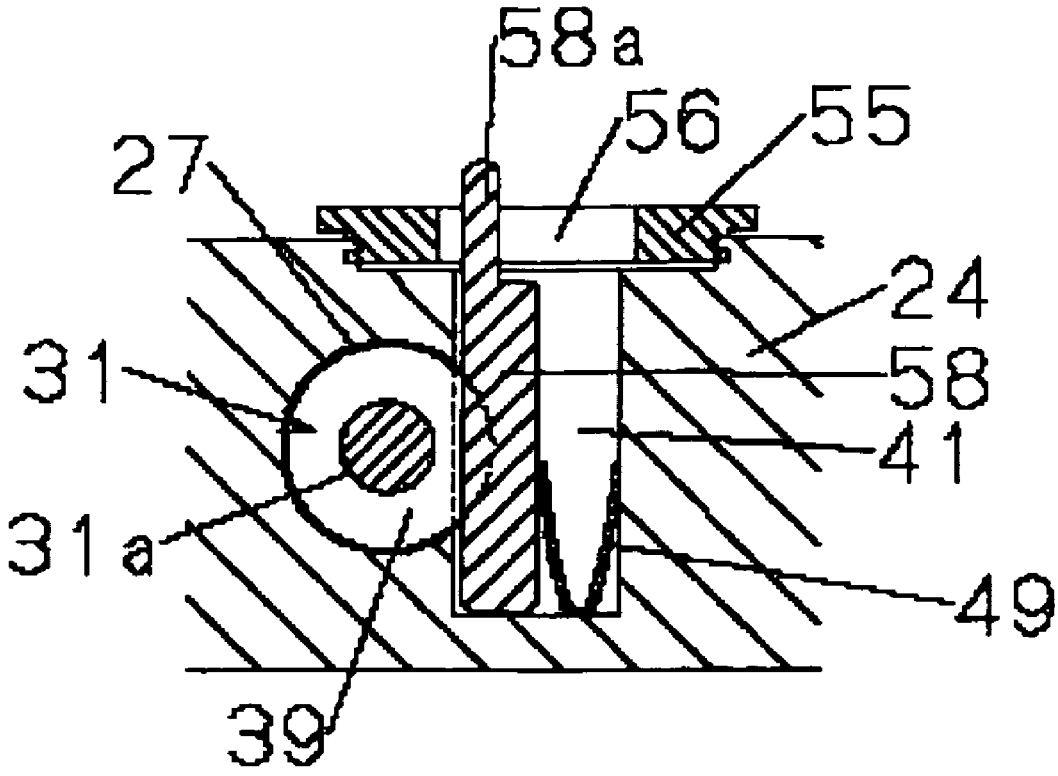
FIG. 11 is a sectional view taken along the line F11-F11 of FIG. 10.
Figure 12:
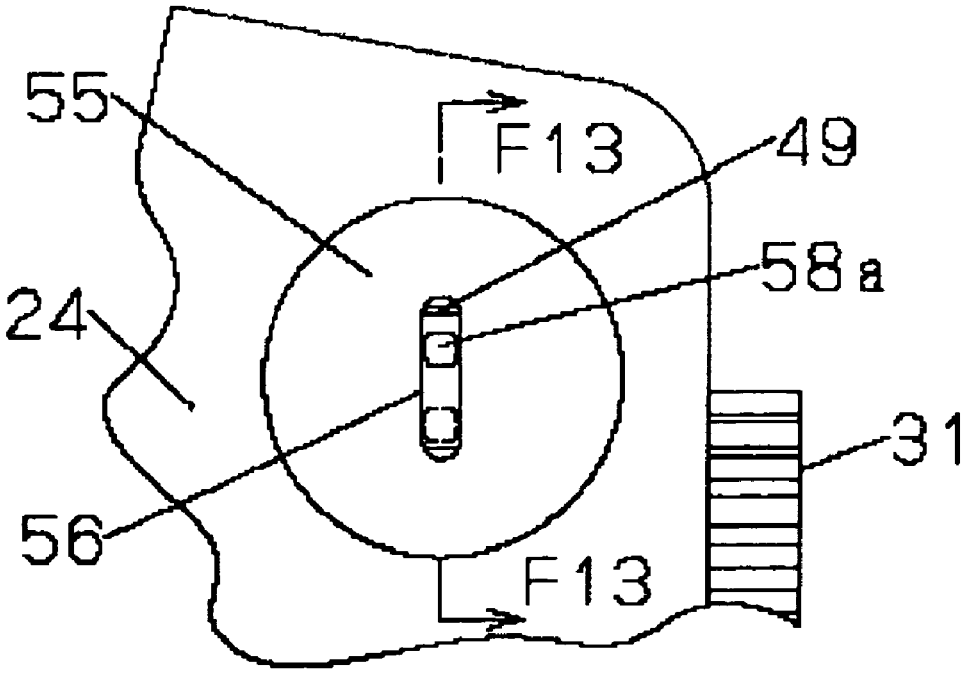
FIG. 12 is a partial front view of the wristwatch of the second embodiment of the present invention with the crown lock lever thereof at a lock canceling position.
Figure 13:
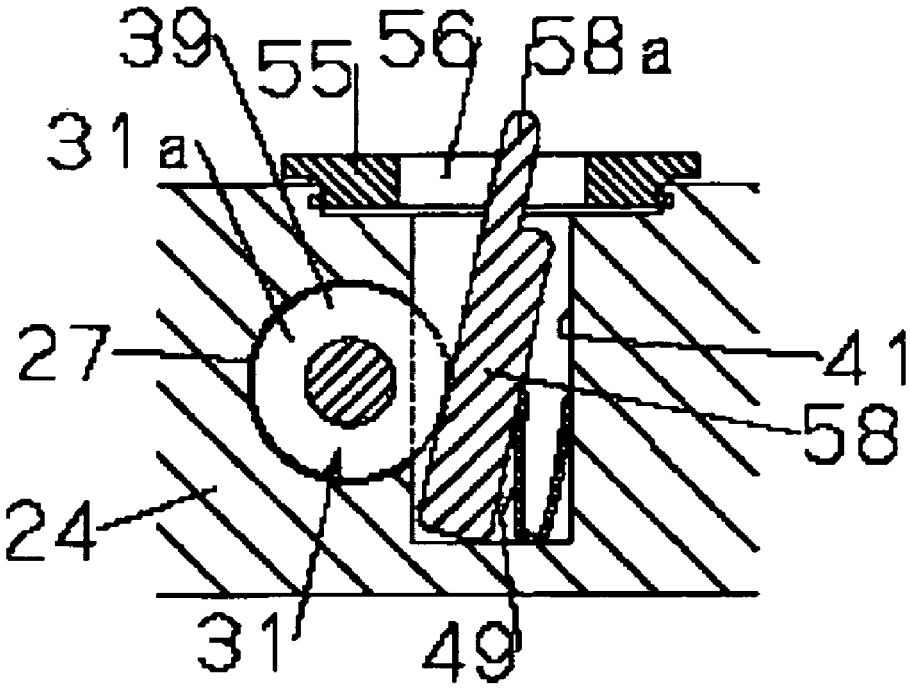
FIG. 13 is a sectional view taken along the line F13-F13 of FIG. 12.

As described above, in the second embodiment, the crown lock member consists of the crown lock lever 58 that is tiltable, so that it is possible to operate the crown 31 through a one-touch operation of tilting the same. That is, by tilting the crown lock lever 58 arranged at the lock position as shown in FIG. 11 away from the crown shaft 31*a* as shown in FIG. 13, the crown lock lever 58 is removed from the movement path of the crown shaft 31*a* and is arranged at the lock canceling position so that it may not constitute an obstruction to the operation of pulling out the crown 31. When, after the operation of the crown, the crown 31 is pushed in through a one-touch operation, the lock groove 39 of the crown 31 is opposed to the crown lock lever 58 and, with this, the crown lock lever 58 is pushed back by the urging force of the urging member 49 so as to be brought into contact with the crown shaft 31*a*, entering the lock groove 39 to be engaged therewith, so that the crown 31 is retained so as not to be erroneously pulled out.

As described above, in the second embodiment also, the prevention of erroneous operation of the crown 31 and the enabling of the operation of the crown 31 can be realized through a one-touch push-in operation of the crown 31 and a one-touch operation of tilting the crown lock lever 58 constituting the crown lock member, thereby providing a satisfactory operability.

What is claimed is:

1. A portable watch comprising: a watch exterior member which is equipped with a case band and which has a crown mounting hole formed so as to extend radially through the case band and a member mounting portion communicating with a portion of the crown mounting hole offset from a central portion of the crown mounting hole, vertically perpendicular to the crown mounting hole, and formed in the case band so as to be open at an upper end;

a crown which has a crown shaft equipped with a peripherally continuous lock groove and a crown head portion continuous with this shaft and which is arranged with the crown shaft inserted into the crown mounting hole;

a crown lock member which has an operation end portion protruding from the open upper end of the member mounting portion and is accommodated in the member mounting portion, which is movable between a lock position where it is engaged with the lock groove to constrain the crown and a lock canceling position where it is off the lock groove and cancels the constraint of the crown, and which is arranged at the lock canceling position through a one-touch operation of the operation end portion; and an urging member accommodated in the member mounting portion and urging the crown lock member so as to arrange it at the lock position.

2. A portable watch according to claim 1, characterized in that the crown lock member consists of a crown lock button that can be downwardly pushed in, and this lock button has an engagement shaft portion that is engaged with the lock groove at the lock position and that is arranged at the lock canceling position away from the movement path of the crown shaft, and an escape shaft portion continuous with the upper side of this shaft portion and arranged at the lock canceling position away from the movement path of the crown shaft.

3. A portable watch according to claim 2, characterized in that the member mounting portion has an upper hole portion whose upper end is open, a lower hole portion whose lower end is open, and an intermediate hole portion whose diameter is smaller than that of the upper and lower hole portions and which communicates with the crown mounting hole; the crown lock button has the engagement shaft portion sliding in the intermediate hole portion, the escape shaft portion, and a button head portion continuous with the upper side of the escape shaft portion and capable of retracting into the upper hole portion; the urging member is provided between the button head portion and the bottom of the upper hole portion in a compressed state; and a stopper moving toward and away from the bottom of the lower hole portion is mounted to the lower end portion of the engagement shaft portion.

4. A portable watch according to claim 3, characterized in that a cap closing the lower hole portion is mounted to the case band, and this cap is arranged higher than the surface of the case back of the watch exterior member.

5. A portable watch according to claim 1, characterized in that the crown lock member is a crown lock lever that can be tilted so as to move toward and away from the crown shaft around the lower end portion thereof.

6. A portable watch according to claim 1, characterized in that, even in the state in which the crown has been pulled out to a maximum degree, the lock groove is arranged within the crown mounting hole, and shaft portions of the crown shaft continuous with both sides of the lock groove are supported by the inner surface of the crown mounting hole.

7. A portable watch according to claim 1, characterized in that the crown shaft is equipped with a first shaft member connected to the winding stem and having a lock protrusion, and a second shaft member having a surrounding end portion receiving the first shaft member and the lock groove, continuous with the crown head portion, and having in the surrounding end portion a lock groove allowing sliding of the lock protrusion, with an urging body urging the second shaft member toward the case band exterior side being held in a compressed state between the two shaft members.

8. A portable watch according to claim 1, characterized in that the section of the crown lock button taken in a direction orthogonal to the axial direction is circular, and the urging force of the urging body is the same as or smaller than the urging force of the urging member.

9. A portable watch according to claim 1, characterized in that a protrusion is formed on the case band in correspondence with the 3 o'clock side of a dial arranged on the inner side of the case band, and the crown lock member and the urging member are arranged on this protrusion.

* * * * *